US005315730A

United States Patent [19]

Kim et al.

[11] Patent Number: 5,315,730

[45] Date of Patent: May 31, 1994

[54] TOOTHBRUSH DEVICE

[76] Inventors: Il Pyung Kim; Hyung C. Kim, both of 1023 N. Charles St., Baltimore, Md. 21201

[21] Appl. No.: 758,729

[22] Filed: Sep. 9, 1991

Related U.S. Application Data

[63] Continuation of Ser. No. 581,880, Sep. 13, 1990, abandoned.

[51] Int. Cl.[5] ..... A46B 9/04

[52] U.S. Cl. ..... 15/167.1; 15/143.1

[58] Field of Search ..... 15/167.1, 143.1

[56] References Cited

U.S. PATENT DOCUMENTS

| | | | |
|---|---|---|---|
| 1,647,453 | 11/1927 | Krantz | 15/167.1 |
| 2,431,861 | 12/1947 | Babe | 15/167.1 |
| 3,474,481 | 10/1969 | Soleymani et al. | 15/167.1 |
| 4,399,582 | 8/1983 | Ernest et al. | 15/167.1 |
| 4,457,039 | 7/1984 | Massari | 15/167.1 |
| 4,679,273 | 7/1987 | Okin | 15/167.1 |
| 4,738,001 | 4/1988 | Shipp | 15/167.1 |
| 4,800,608 | 1/1989 | Key | 15/167.1 |

*Primary Examiner*—Philip R. Coe
*Assistant Examiner*—Patrick F. Brinson
*Attorney, Agent, or Firm*—Birch, Stewart, Kolasch & Birch

[57] ABSTRACT

A toothbrush device having a bent handle and a longitudinal brush head about the bent handle for perfectly cleaning the tooth without causing any inconvenience to the lips and the mouth.

3 Claims, 1 Drawing Sheet

FIG. 1
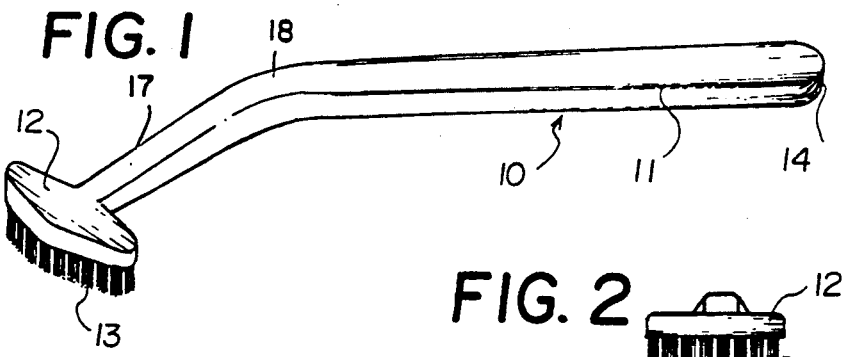
FIG. 2
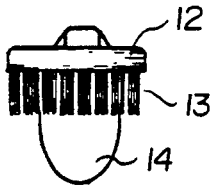
FIG. 3
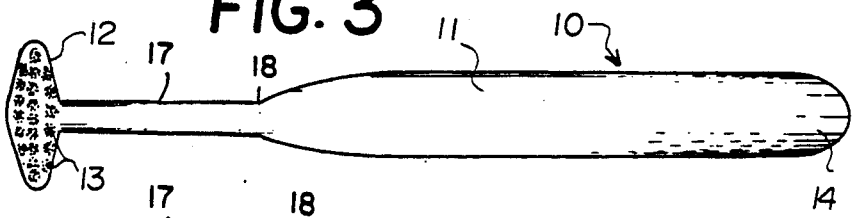
FIG. 4
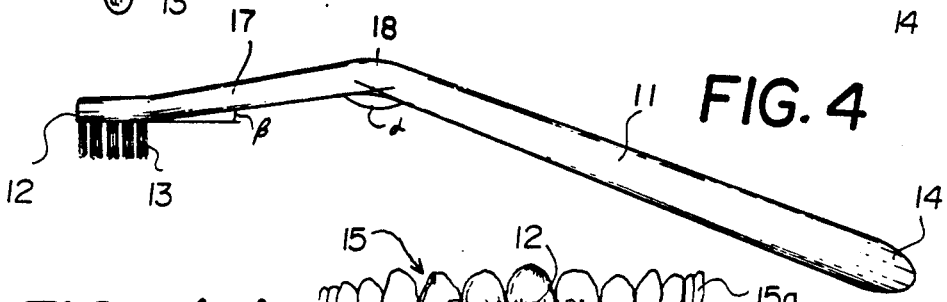
FIG 5(A)
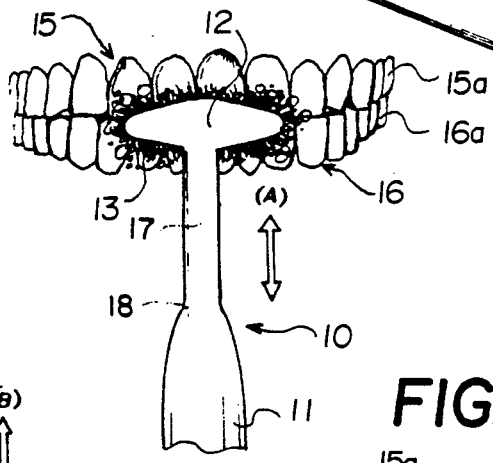
FIG. 5(C)
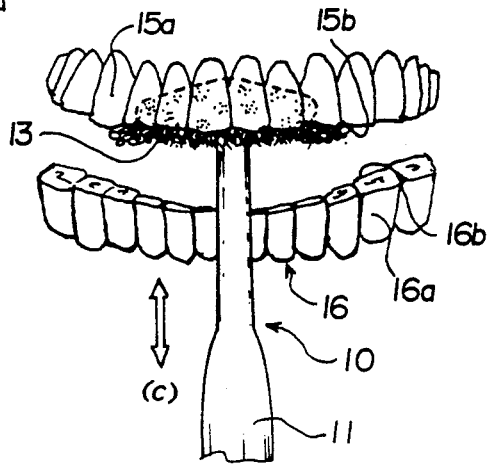
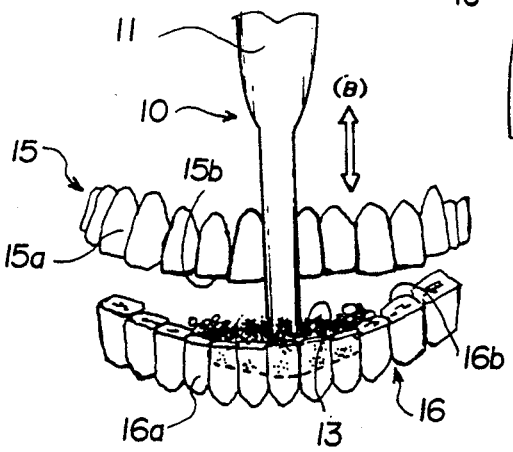
FIG. 5(B)

TOOTHBRUSH DEVICE

This application is a continuation of application Ser. No. 07/581,880 filed on Sep. 13, 1990, now abandoned.

BACKGROUND OF THE INVENTION

1. Field of the Invention

The present invention relates to a toothbrush device for cleaning the teeth and more particularly, to a toothbrush device having a longitudinal brush head about a bent handle for perfectly cleaning the teeth without causing any inconvenience to the lips and the mouth.

2. Description of the Prior Art

Various types of toothbrushes are well known in the art. Such toothbrushes have a vertical brush head about a straight handle or a bent handle. Also, although such toothbrushes have a longitudinal brush head about a bent handle, they do not include an adequate bent handle. However, such toothbrushes suffer from a many of disadvantages such as, for example, frequent interference occurred between the hand holding the toothbrush and the chin cannot avoid, and it is difficult for such toothbrushes to perfectly clean the inner surface of the teeth.

SUMMARY OF THE INVENTION

Accordingly, it is an object of the present invention to provide an improved toothbrush device.

Another object of the present invention is to provide a toothbrush having a longitudinal brush head about a bent handle for perfectly cleaning the teeth without causing any inconvenience to the lips and the mouth.

A further object of the present invention is to provide a toothbrush having a bent handle and a longitudinal brush head about the bent handle wherein the bent handle is provided with a mid bent portion having about 155° of an angle and an arm having about 5° of an angle based on the longitudinal brush head so as to avoid any interference occurred between the hand holding the toothbrush, and the chin and the nose.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a toothbrush device having a bent handle and a longitudinal brush head about the bent handle for perfectly cleaning the tooth without causing any inconvenience to the lips and the mouth.

BRIEF DESCRIPTION OF THE DRAWINGS

The present invention will become more fully understood from the detailed description given hereinbelow and the accompanying drawing which are given by way of illustration only, and thus are not limitative of the present invention, and wherein:

FIG. 1 is a perspective view of the toothbrush device according to the present invention;

FIG. 2 is a left elevational view of the toothbrush device according to the present invention;

FIG. 3 is a bottom plan view of the toothbrush device according to the present invention;

FIG. 4 is a front elevational view of the toothbrush device according to the present invention FIG. 5(A) is a front elevational view of the toothbrush according to the present invention showing the operation thereof for cleaning the outer surfaces of the upper and lower teeth;

FIG. 5(B) is a front elevational view of the toothbrush according to the present invention showing the operation thereof for cleaning the inner surface of the lower teeth; and FIG. 5(C) is a front elevational view of the toothbrush according to the present invention showing the operation thereof for cleaning the inner surface of the upper teeth.

DESCRIPTION OF THE PREFERRED EMBODIMENTS

Referring now in detail to the drawings for the purpose of illustrating preferred embodiments of the present invention, the toothbrush device 10 as shown in FIGS. 1, 2, and 3, comprises a bent handle 11 and a longitudinal brush head 12 extended from the bent handle 11 disposed at one end thereof.

The bent handle 11 includes a handle grip 14 disposed at the other end portion thereof, a mid bent portion 18 disposed nearer to the brush head 12 than the handle of 14, and an arm 17 disposed at one end portion thereof. The length of the arm 17 is about one fourth of the whole bent handle 11. The mid bent portion 18 contains an angle $\alpha$ having about 150° to 160°, preferably 155° and the arm 17 is provided with an angle $\beta$ of about 3° to 7°, preferably 5° about the brush head 12 for perfectly cleaning without causing any inconvenience to the lips and the mouth (not shown).

The brush head 12 carries a plurality of bristles 13 arranged thereon and has a diamond shaped configuration for easily cleaning the teeth located at the deep inside of the mouth.

As shown in FIGS. 5(A), 5(B), and 5(C), the toothbrush device according to the present invention operates as follows.

When the user applies the toothbrush 10 to the outer surfaces 15*a* and 16*a* of the upper teeth 15 and the lower teeth 16 and moves up and down in the direction indicated by arrow (A) in FIG. 5(A), any interference occurred between the hand holding the toothbrush 10 and the chin is avoided.

When the user applies the toothbrush 10 to the inner surface 16*b* of the lower teeth 16 and moves up and down in the direction indicated by arrow (B) in FIG. 5(B), any interference occurred between the hand holding the toothbrush 10 and the nose is avoided.

Any interference occurred between the hand holding the toothbrush 10 and the chin is avoided when the user applies the toothbrush 10 to the inner surface 15*b* of the upper teeth 15 and moves up and down in the direction indicated by arrow (C) in FIG. 5(C).

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A tooth brush device comprising:

a brush head and a handle member, said brush head having a diamond shaped configuration for easily cleaning the teeth located at deep recesses of the mouth and a plurality of bristles arranged on said brush head, and said handle member including an arm portion and a bent handle portion, said arm portion extending upward from said brush head at an angle of about 3° to 7° and said arm portion forming an angle with said bent portion of 150° to 160° at a point of about one-fourth the distance of said handle member from said brush head, whereby upon applying the toothbrush to the teeth, any interference occurring because of the hand holding the toothbrush, the chin and the nose are avoided so as to perfectly clean the teeth without causing any inconvenience with respect to brushing teeth between the lips and in the mouth.

2. The toothbrush device of claim 1, wherein the angle of the bent portion is 155°.

3. The toothbrush device of claim 1, wherein the angle of arm about the brush head is 5°.

* * * * *